United States Patent [19]

Safrit et al.

[11] 4,213,312

[45] Jul. 22, 1980

[54] PANTY HOSE WITH STRETCH-COTTON PANTY

[75] Inventors: Sam C. Safrit, Pfafftown; Edward L. Cassidy, Sr.; William B. Cothran, both of Burlington; Roscoe M. Farrell, Pittsboro, all of N.C.

[73] Assignee: Alamance Industries, Inc., Burlington, N.C.

[21] Appl. No.: 901,434

[22] Filed: May 1, 1978

[51] Int. Cl.[2] ..... A41B 9/02; A41B 9/04; A41B 9/10

[52] U.S. Cl. ..... 66/177; 2/409; 66/202

[58] Field of Search ..... 66/177, 175, 202; 2/409, 239

[56] References Cited

U.S. PATENT DOCUMENTS

| | | | |
|---|---|---|---|
| 2,102,368 | 12/1937 | Marter | 66/85 |
| 3,757,354 | 9/1973 | Moody | 66/177 |
| 3,760,611 | 9/1973 | Duckworth | 66/177 |
| 3,800,564 | 4/1974 | Carswell | 66/136 |
| 4,065,942 | 1/1978 | Kejnovsky | 66/177 |

OTHER PUBLICATIONS

Wignalc, "Hosiery Technology," Knitted Outerwear Assoc., 1968, N. Y. pp. 63–64.

*Primary Examiner*—Ronald Feldbaum

*Attorney, Agent, or Firm*—Bell, Seltzer, Park & Gibson

[57] ABSTRACT

The stretch-cotton panty portion of the panty hose includes the combination of stretchable textured thermoplastic yarn forming the outer face and nonstretchable cotton yarn on the inner face. The stretchable and cotton yarns are so knitted as to retain substantially the full stretchable and smooth conforming fit characteristics of lightweight sheer stretch thermoplastic fabric together with the soft sanitary moisture absorbing characteristics of cotton without appreciable bulk, rigidity, or heaviness. The cotton on the inner face is knitted by plating a lightweight cotton yarn on the inner surfaces of selected noncontiguous courses of the stretch thermoplastic yarn.

11 Claims, 4 Drawing Figures

PANTY HOSE WITH STRETCH-COTTON PANTY

This invention relates generally to knitted panty hose with a stretch-cotton panty portion and more particularly to such a garment combining in the panty portion, the characteristics of stretchable thermoplastic fabric with a nonstretchable cotton inner face without appreciable bulk, rigidity, heaviness or loss of stretchability.

Relatively lightweight sheet panty hose have become increasingly popular in recent years with the advent of thermoplastic yarns which have been twisted, crimped or otherwise textured for stretchability so that one panty hose will fit wearers within a range of sizes. While it has frequently been suggested that panty hose be worn without other undergarments, most wearers have continued to wear a conventional panty under the panty hose.

More recently, efforts have been made to incorporate the weight, thickness, feel, or comfort of a separate undergarment into the panty portion of panty hose. For example, a complete inner fabric liner has been proposed, and heavier yarns have been incorporated into the panty portion. However, the provision of a thicker or heavier panty portion has not been entirely satisfactory because the heavy panty portion does not have the soft, smooth, lightweight feel of conventional panties and the smooth, body conforming, open, sheer characteristics of stretch panty hose are sacrificed.

Undergarments of cotton yarns have the desirable characteristics of being nontoxic, sanitary and absorbent and some efforts have been made to obtain the benefit of desirable cotton characteristics in the panty portion of panty hose. For example, Moody U.S. Pat. No. 3,757,354 discloses the formation of free terry loops forming a thick cushion surface on the inner face of the panty portion. While giving maximum softness and absorbency, the bulky cotton cushion is thick, heavy, warm and greatly restricts the stretchability of the panty portion as well as its hand, sheerness and breathability. Another effort to utilize cotton is illustrated in Duckworth U.S. Pat. No. 3,760,611 which discloses incorporating cotton yarn in the panty portion by knitting the cotton yarn alone in spaced courses while forming stitch loops in spaced-apart wales and tucks therebetween to form free loops of the cotton yarn protruding from the inner surface of the fabric. This effort to form protruding cotton loops also tends to make the panty fabric heavy and bulky as well as limiting stretchability and creating an uneven inner surface. Also in this construction, the spaced stitch loops of the cotton yarn appear on the outer face of the panty, creating dye problems and undesirable appearance.

With the foregoing in mind, it is an object of the present invention to provide a panty hose with a stretch-cotton panty portion which includes the combination of stretchable textured thermoplastic yarn forming the outer face and nonstretchable cotton yarn on the inner face so knitted as to retain substantially the full stretchable and smooth conforming fit characteristics of lightweight sheer stretch thermoplastic fabric while providing the inner surface of the panty portion with the soft, sanitary, nontoxic and moisture absorbing characteristics of the cotton yarn.

It is another object of this invention to provide in the panty portion of panty hose a cotton inner face wherein fine cotton yarn is knit in plated relationship with the stretchable body yarn in selected noncontiguous courses so as to lie wholly on the inner surface of the panty and wherein the panty portion is not objectionably bulky, thick and heavy, the cost of production is not unreasonably increased, and the sheer, stretchable, open, cool characteristics of the panty portion are substantially retained. This unique combination permits moisture absorbed by the soft staple cotton yarn next to the skin to be wicked to the outer open surface of the sheer stretchable fabric to prevent any wet or "clammy" feeling while maintaining a smooth inner surface and a lightweight relatively sheer and stretchable fabric.

In accordance with the invention, the panty portion of the panty hose is knit of a thermoplastic main body yarn, preferably continuous filament nylon, of about 50 to 100 denier, twisted, crimped or otherwise textured to cause it to retract when relaxed and to provide sufficient stretchability that the panty portion will extend and retract to fit a range of body sizes. The cotton yarn inner face of the panty portion is formed by knitting a fine lightweight staple cotton yarn in plated relationship with the main body yarn and in selected noncontiguous courses so that the cotton yarn, which is smaller than the thermoplastic main body yarn, is plated to lie on the inside of the panty area. The leg and foot portions of the panty hose are knit of a lighter weight textured thermoplastic yarn, preferably about 30 denier or less, to provide a sheer appearance and sufficient stretchability to fit a range of leg and foot sizes.

In one embodiment, the panty portion is knit with a main body yarn of 70/34 denier nylon which has been textured by the false twist process to render it stretchable and retractable and the inner face is formed of fine cotton yarn, 96 single count, plated in every stitch loop of every fourth course throughout the panty portion.

In another embodiment, the panty portion is knit of stretchable main body yarn with a lighter smaller size cotton yarn plated on the inner surface of selected noncontiguous courses and wherein a spandex elastomeric yarn is also knit in selected courses to provide an inwardly directed compressive force against the body of the wearer. It is preferred that the spandex yarn be plated with the stretchable yarn in the courses immediately adjacent opposite sides of the courses in which the cotton yarn is plated with the stretchable main body yarn. The leg and foot portions of each embodiment of the panty hose are seamless knit and may be of any known construction, preferably of 30 denier or less. For example, leg and foot portions knit of an 18/7 denier textured nylon yarn provide a satisfactory sheer appearance and sufficient stretchability to fit a range of leg and foot sizes.

Other objects and advantages will appear as the description proceeds when taken in connection with the accompanying drawings, in which FIG. 1 is a perspective front view of a panty hose garment constructed in accordance with the present invention and illustrated in substantially the condition the panty hose assumes when being worn;

Figure 1:
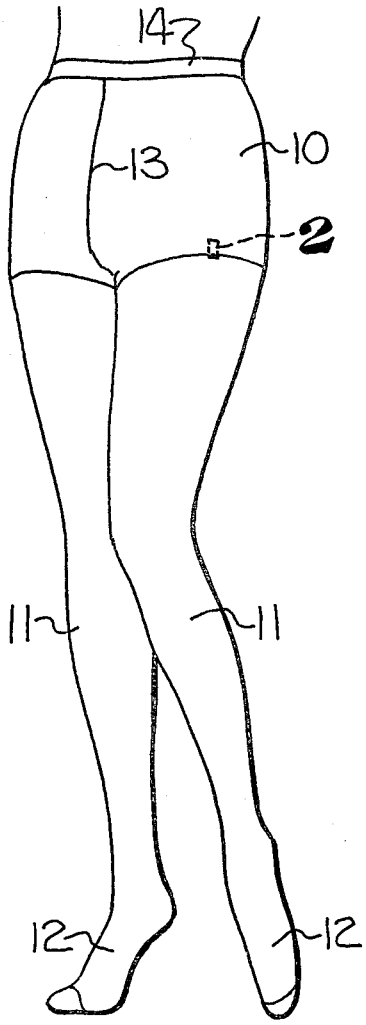

The present lightweight stretchable panty hose garment, as illustrated in FIG. 1, includes a panty portion 10 with integrally knit leg portions 11 and foot portions 12. The panty portion 10 is illustrated as being formed in the conventional manner by forming longitudinal slits extending downwardly from the upper end portions of elongated stocking blanks and then seaming the adjacent slit edges together along a seam line 13 in the well-known manner. The seam extends from the waist opening at the front and downwardly through the crotch and up the rear to the waist opening. If desired, a suitable crotch patch, not shown, may be incorporated in the seam 13 and the upper waist opening of the panty portion 10 is provided with an elastic welt or an elastic band or tape 14.

Figure 2:
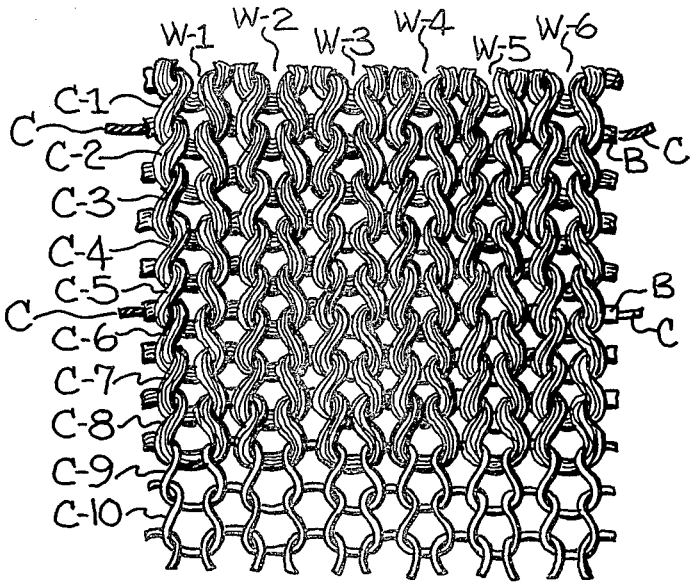
FIG. 2 is a fragmentary enlarged view of a small area of the fabric in the lower edge of the panty and the upper edge of the leg, being taken substantially in the area enclosed by the dotted rectangle 2 in FIG. 1 and with the fabric in stretched condition.

The panty portion 10 is characterized by an outer face knit of a main body yarn, indicated at B, of thermoplastic textured yarn and having substantially stretchable, retractable, and smooth conforming fit characteristics. As illustrated in FIG. 2, the main body yarn B forms stitch loops in every wale W-1 through W-6 of every course C-1 through C-8 of the panty portion 10 so that the characteristics of the outer surface or face of the panty portion 10 are dominated by the characteristics of the main body yarn B. The panty portion 10 is also characterized by an inner surface or face with non-stretchable staple cotton yarn, indicated at C, knit in plated relationship with the main body yarn B substantially throughout selected courses so as to lie on the inner face of the main body yarn stitch loops and to be positioned adjacent the skin of the wearer, as illustrated in courses C-2 and C-6 of FIG. 3. The courses C-2 and C-6 containing the plated cotton yarn C are noncontiguous or nonconsecutive so that the stitch loops of cotton yarn are not directly connected to other stitch loops of cotton yarn and the stretchable open lightweight characteristics of the main body yarn fabric are not restricted by the cotton yarn. The cotton yarn C thus provides a smooth inner surface in the panty portion 10 and sanitary, nontoxic, and moisture absorbing characteristics adjacent the skin of the wearer.

It is preferred that the main body yarn B be continuous multifilament nylon of about 50 to 100 denier, twisted, crimped or otherwise textured to cause it to retract when relaxed and to provide sufficient stretchability that the panty portion 10 will extend and retract to fit a range of body sizes. It has been found that satisfactory characteristics can be obtained in the panty portion by knitting the panty portion with a main body yarn of 30/34 denier nylon which has been textured by the false twist process.

Figure 3:
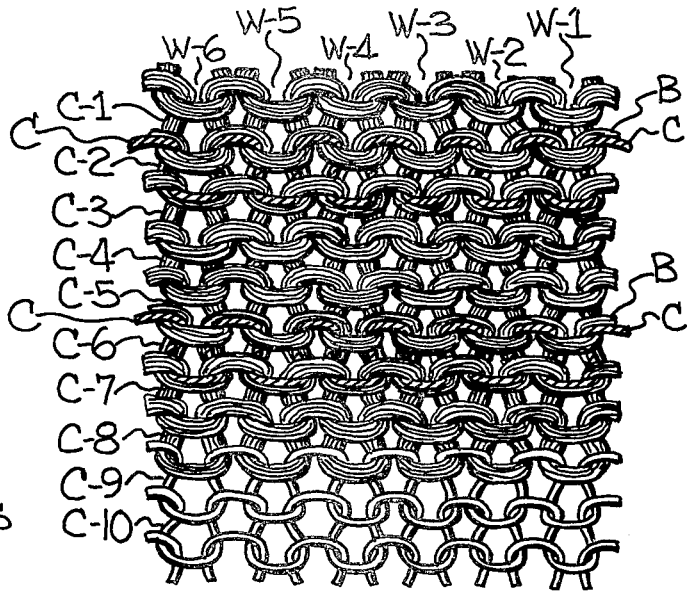
FIG. 3 is a view similar to FIG. 2 but looking at the reverse side of the fabric.

It is also preferred that the cotton yarn C be not more than about 75 percent as large as the main body yarn B and that the cotton yarn C be plated with the main body yarn B in every stitch loop of every fourth course throughout the panty portion, as illustrated in courses C-2 and C-6 of FIG. 3. It has been found that when a 30/34 denier textured nylon is used as the main body yarn B, the desired characteristics are present in the panty portion 10 when a fine cotton yarn having a 96 single count is plated in every fourth course.

Figure 4:
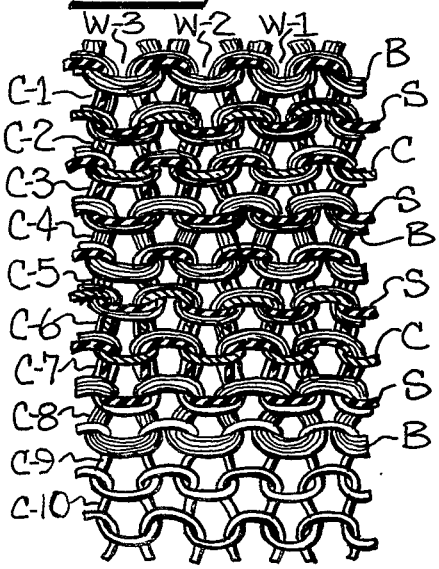
FIG. 4 is a view similar to FIG. 3 but showing another embodiment with a spandex yarn being incorporated in the panty portion for increasing the compressive force with which the panty portion engages the body.

In the embodiment of the panty portion illustrated in FIG. 4, the stretchable main body yarn B is again knit in every wale and course of the panty portion 10 and the fine cotton yarn C is plated on the inside of every stitch loop in courses C-2 and C-6. Additionally, a spandex or elastomeric yarn, indicated at S, is knit in plated relationship with the main body yarn B and in selected noncontiguous or nonconsecutive courses of the panty portion 10. As illustrated in FIG. 4, the spandex yarn S is knit in plated relationship with each stitch loop of the main body yarn B in every other course (the odd numbered courses). The spandex yarn S is not knit in the same courses in which the cotton yarn is knit (courses C-2 and C-6) but is knit in the courses immediately adjacent the courses in which the cotton yarn C is knit, that is, in courses C-1, C-3, and C-5, C-7. The spandex or elastomeric yarn S is thus knit in plated relationship with the main body yarn B in every other course and provides an inwardly directed compressive force against the body of the wearer.

In both embodiments of the panty hose, the leg and foot portions 11, 12 are knit of a lighter weight textured thermoplastic yarn of not over about 30 denier to provide a sheer appearance and sufficient stretchability to fit a range of leg and foot sizes. For example, it has been found that the leg and foot portions 11, 12 may be knit of an 18/7 denier textured nylon yarn to provide a satisfactory sheer appearance and sufficient stretchability.

The knitting of the panty portion 10 will be described as being knit on a conventional four feed fine gauge ladies' hosiery knitting machine. However, it is to be understood that the panty portion 10 may be knit on other types of seamless knitting machines. During the knitting of the panty portion 10, the nylon body yarn B is fed to and knit on every needle at three consecutive feed stations while the cotton yarn C and the body yarn B are both fed to and knit on every needle at the other feeding station. Thus, three consecutive courses, as illustrated in courses C-3, C-4 and C-5 of FIGS. 2 and 3, are formed entirely of the stretchable main body yarn B while the cotton yarn C is knit in plated relationship with the body yarn B in every fourth course (as illustrated in courses C-2 and C-6 of FIGS. 2 and 3). This pattern is repeated throughout the knitting of the panty portion of the elongated blank and the lightweight yarn is introduced at all four feeds to knit the leg and foot portions 11, 12.

During the knitting of the panty portion 10, it is important to maintain the textured thermoplastic body yarn B under substantial tension, for example, 4–6 grams, so that the filaments will be tensioned toward a straight parallel condition and at the same time the lighter weight cotton yarn C should be knit under little or no appreciable tension. Thus, as the stretchable nylon yarn tends to contract in the fabric, there will be a sufficient amount of cotton yarn to conform to the full stitch loop configuration of the body yarn as originally drawn by the needles and to thereby permit stretching of the fabric without adversely affecting the stretchable characteristics of the textured yarn. The lightweight cotton yarn will thus lie on the inner surface of the fabric and will be virtually invisible from the outer surface of the fabric, minimizing problems with dyeing inherently different yarns, streaks, barre, and the like, yet the ends or projecting fibers of the cotton yarn will tend to fill the interstices between the loops of the thermoplastic yarn for enhancing the softness, hand, and appearance of the fabric.

The knitting of the embodiment of the panty portion shown in FIG. 4 is the same as described in connection with the first embodiment except that the spandex or elastomeric yarn, illustrated at S, is fed to and knit with the nylon body yarn B at the feeding station immediately before and the feeding station immediately after the feeding station at which the cotton yarn C and nylon yarns B are fed together. Thus, as illustrated in FIG. 4, the spandex yarn S is knit in every other course and in the courses immediately adjacent the courses in which the cotton yarn C is knit. The spandex yarn S is knit in plated relationship with the body yarn B so that it does not appear on the outer surface of the panty portion 10 and provides an inwardly directed compressive force against the body of the wearer.

The panty hose garment of the present invention thus includes a lightweight stretchable panty portion 10 characterized by an outer surface or face knit of a textured thermoplastic main body yarn B and having substantially stretchable, retractable, and smooth conforming fit characteristics in combination with an inner face or surface of nonstretchable staple cotton yarn C. The cotton yarn C is knitted in plated relationship with the main body yarn B substantially throughout selected courses so as to lie on the inner surface of the stitch loops of the main body yarn B and adjacent the skin of the wearer. The courses of cotton yarn C are noncontiguous or nonconsecutive so that the stretchable open lightweight characteristics of the fabric of the panty portion 10 are not restricted by the cotton yarn C.

In the drawings and specification, there has been set forth a preferred embodiment of the invention, and although specific terms are employed, they are used in a generic and descriptive sense only and not for purposes of limitation, the scope of the invention being defined in the claims.

That which is claimed is:

1. A lightweight stretchable panty hose garment including a panty portion characterized by an outer face knit of thermoplastic textured main body yarn and having substantially stretchable, retractable, and smooth conforming fit characteristics in combination with an inner surface of nonstretchable staple cotton yarn, said cotton yarn being knitted in plated relationship with the main body yarn substantially throughout some courses so as to lie on the inner surface of the main body yarn loops adjacent the skin of the wearer, the courses containing cotton yarn being noncontiguous and being spaced apart by at least two courses of said main body yarn, whereby the stretchable open lightweight characteristics of the main body yarn fabric are not restricted by the cotton yarn, and said courses of cotton yarn plated with said main body yarn being spaced apart by no more than about three courses of said main body yarn so that the courses containing the cotton yarn are sufficiently close together to provide a soft, sanitary, nontoxic and moisture absorbing inner surface on said panty portion.

2. A panty hose garment according to claim 1 wherein said main body yarn is multi-filament and within the range of about 50 to 100 denier.

3. A panty hose garment according to claim 2 wherein said nonstretchable staple cotton yarn is not more than about 75 percent as large as said main body yarn.

4. A panty hose garment according to claim 1 wherein said cotton yarn is knit in plated relationship with said main body yarn in every fourth course.

5. A panty hose garment according to claim 1 including a spandex yarn knit in plated relationship with said main body yarn in selected noncontiguous courses of said panty portion to provide an inwardly directed compressive force against the body of the wearer.

6. A panty hose garment including a stretchcotton panty portion and integrally knit leg and foot portions, said panty portion being knit of a main body yarn in every course, said main body yarn being textured multi-filament thermoplastic and within the range of about 50 to 100 denier to provide sufficient stretchability that said panty portion will fit a range of body sizes, said panty portion also including an auxiliary yarn knit in plated relationship with said main body yarn and in selected nonconsecutive courses, said auxiliary yarn being nonstretchable staple cotton and not more than about 75 percent as large as said main body yarn, said auxiliary cotton yarn being maintained on the inside of said panty portion so that the characteristics of the outside of said panty portion are dominated by said main body yarn, said auxiliary cotton yarn being knit in nonconsecutive courses of said panty portion so that the lightweight and stretchable characteristic of said panty portion are substantially retained, said auxiliary cotton yarn providing a smooth inner surface in said panty portion and sanitary, nontoxic, and moisture absorbing characteristics adjacent the skin of the wearer, and a spandex yarn knit in selected nonconsecutive courses of said panty portion, said spandex yarn being knit in plated relationship with said main body yarn to provide an inwardly directed compressive force against the body of the wearer, said leg and foot portions being seamless knit of lightweight textured thermoplastic yarn of not over about 30 denier to provide a sheer appearance and sufficient stretchability to fit a range of leg and foot sizes.

7. A panty hose garment according to claim 6 wherein said spandex yarn in knit in plated relationship with said main body yarn in courses immediately adjacent the courses in which said auxiliary cotton yarn is knit.

8. A panty hose garment according to claim 6 wherein said main body yarn of said panty portion is 70 denier and wherein said auxiliary cotton yarn in 96 single count.

9. A panty hose garment according to claim 6 wherein said auxiliary cotton yarn is plated with said main body yarn in every fourth course.

10. A panty hose garment according to claim 9 including a spandex yarn knit in plated relationship with said main body yarn and in every other course to provide an inwardly directed compressive force against the body of the wearer.

11. A lightweight stretchable panty hose garment including a panty portion characterized by an outer face knit of thermoplastic textured main body yarn and having substantially stretchable, retractable, and smooth conforming fit characteristics in combination with an inner surface of nonstretchable staple cotton yarn, said cotton yarn being knitted in plated relationship with the main body yarn substantially throughout some courses so as to lie on the inner surface of the main body yarn loops adjacent the skin of the wearer, the courses containing cotton yarn being noncontiguous, whereby the stretchable open lightweight characteristics of the main body yarn fabric are not restricted by the cotton yarn, and said courses of cotton yarn plated with said main body yarn being spaced apart by at least two courses no more than about three courses of said main body yarn so that the cotton yarn does not restrict the stretchable open lightweight characteristics of the main body yarn fabric and the courses containing the cotton yarn are sufficiently close together to provide a soft, sanitary, nontoxic and moisture absorbing inner surface on said panty portion.

* * * * *